US007254949B2

(12) United States Patent
Brasz et al.

(10) Patent No.: US 7,254,949 B2
(45) Date of Patent: Aug. 14, 2007

(54) TURBINE WITH VANED NOZZLES

(75) Inventors: Joost J. Brasz, Fayetteville, NY (US); Bruce P. Biederman, West Hartford, CT (US)

(73) Assignee: UTC Power Corporation, South Windsor, CT (US)

( * ) Notice: Subject to any disclaimer, the term of this patent is extended or adjusted under 35 U.S.C. 154(b) by 539 days.

(21) Appl. No.: 10/293,711

(22) Filed: Nov. 13, 2002

(65) Prior Publication Data

US 2004/0088986 A1 May 13, 2004

(51) Int. Cl.
*F01K 23/10* (2006.01)

(52) U.S. Cl. ..... 60/618; 60/651; 60/671; 415/202; 415/203

(58) Field of Classification Search ..... 60/670, 60/614, 616, 618, 597, 651, 671; 415/120, 415/202, 203
See application file for complete search history.

(56) References Cited

U.S. PATENT DOCUMENTS

| | | | | |
|---|---|---|---|---|
| 3,393,515 A | | 7/1968 | Tabor et al. | |
| 3,830,062 A | * | 8/1974 | Morgan et al. | 60/618 |
| 4,386,499 A | | 6/1983 | Raviv et al. | |
| 4,458,493 A | | 7/1984 | Amir et al. | |
| 4,590,384 A | | 5/1986 | Bronicki | |
| 4,617,808 A | | 10/1986 | Edwards | |
| 4,760,705 A | | 8/1988 | Yogev et al. | |
| 4,901,531 A | | 2/1990 | Kubo et al. | |
| 5,038,567 A | | 8/1991 | Mortiz | |
| 5,119,635 A | | 6/1992 | Harel | |
| 5,145,317 A | | 9/1992 | Brasz | |
| 5,207,565 A | * | 5/1993 | Roessler | 417/407 |
| 5,252,027 A | | 10/1993 | Brasz | |
| 5,266,002 A | | 11/1993 | Brasz | |
| 5,339,632 A | | 8/1994 | McCrabb et al. | |
| 5,445,496 A | | 8/1995 | Brasz | |
| 5,598,706 A | | 2/1997 | Bronicki et al. | |
| 5,632,143 A | | 5/1997 | Fisher et al. | |
| 5,640,842 A | | 6/1997 | Bronicki | |
| 5,664,419 A | | 9/1997 | Kaplan | |
| 5,761,921 A | | 6/1998 | Hori et al. | |
| 5,807,071 A | | 9/1998 | Brasz et al. | |

(Continued)

FOREIGN PATENT DOCUMENTS

| | | |
|---|---|---|
| EP | 0 050 959 A1 | 5/1982 |
| EP | 0 050 959 B1 | 5/1982 |
| EP | 0 121 392 | 10/1984 |
| WO | 96/39577 | 12/1996 |

OTHER PUBLICATIONS

Honeywell, HFC-245fa, . . . An Ideal Zero-ODP Blowing Agent.
Gary J. Zyhowski, Sr., Mark W. Spatz and Samuel Motta, An Overview of the Properties and Applications of HFC-245fa.
Thermodynamics of Waste Heat Recovery in Motor Ships, Professor A.J. Morton, MSc, Manchester University, Mechanical Engineering Dept., Trans I Mar E (C), 1981, vol. 93, Paper C69, pp. 1-7.

*Primary Examiner*—Hoang Nguyen
(74) *Attorney, Agent, or Firm*—Marjama & Bilinski LLP

(57) ABSTRACT

A machine designed as a centrifugal compressor is applied as an organic rankine cycle turbine by operating the machine in reverse. In order to accommodate the higher pressures when operating as a turbine, a suitable refrigerant is chosen such that the pressures and temperatures are maintained within established limits. Such an adaptation of existing, relatively inexpensive equipment to an application that may be otherwise uneconomical, allows for the convenient and economical use of energy that would be otherwise lost by waste heat to the atmosphere.

11 Claims, 6 Drawing Sheets

U.S. PATENT DOCUMENTS 5,809,782 A 9/1998 Bronicki et al.
5,860,279 A 1/1999 Bronicki et al.
5,895,793 A 4/1999 Kitamura et al.
6,009,711 A 1/2000 Kreiger et al.
6,041,604 A 3/2000 Nicodemus
6,050,083 A 4/2000 Meckler
6,101,813 A 8/2000 Sami et al.
6,233,938 B1 5/2001 Nicodemus
6,301,889 B1 * 10/2001 Gladden et al. ..... 60/605.2
6,374,629 B1 * 4/2002 Oberle et al. ..... 62/473
6,393,840 B1 * 5/2002 Hay ..... 60/618
6,497,090 B2 12/2002 Bronicki et al.
6,539,718 B2 4/2003 Bronicki et al.
6,539,720 B2 4/2003 Rouse et al.
6,539,723 B2 4/2003 Bronicki et al.
6,571,548 B1 6/2003 Bronicki et al.
6,598,397 B2 * 7/2003 Hanna et al. ..... 60/651
2002/0148225 A1 10/2002 Lewis
2003/0029169 A1 2/2003 Hanna et al.
2003/0089110 A1 5/2003 Niikura et al.
2003/0167769 A1 9/2003 Bharathan et al.

* cited by examiner

TURBINE WITH VANED NOZZLES

BACKGROUND OF THE INVENTION

This invention relates generally to organic rankine cycle systems and, more particularly, to economical and practical methods and apparatus therefor.

The well known closed rankine cycle comprises a boiler or evaporator for the evaporation of a motive fluid, a turbine fed with vapor from the boiler to drive the generator or other load, a condenser for condensing the exhaust vapors from the turbine and a means, such as a pump, for recycling the condensed fluid to the boiler. Such a system as is shown and described in U.S. Pat. No. 3,393,515.

Such rankine cycle systems are commonly used for the purpose of generating electrical power that is provided to a power distribution system, or grid, for residential and commercial use across the country. The motive fluid used in such systems is often water, with the turbine then being driven by steam. The source of heat to the boiler can be of any form of fossil fuel, e.g. oil, coal, natural gas or nuclear power. The turbines in such systems are designed to operate at relatively high pressures and high temperatures and are relatively expensive in their manufacture and use.

With the advent of the energy crisis and, the need to conserve, and to more effectively use, our available energies, rankine cycle systems have been used to capture the so called "waste heat", that was otherwise being lost to the atmosphere and, as such, was indirectly detrimental to the environment by requiring more fuel for power production than necessary.

One common source of waste heat can be found at landfills where methane gas is flared off to thereby contribute to global warming. In order to prevent the methane gas from entering the environment and thus contributing to global warming, one approach has been to bum the gas by way of so called "flares". While the combustion products of methane ($CO_2$ and $H_2O$) do less harm to the environment, it is a great waste of energy that might otherwise be used.

Another approach has been to effectively use the methane gas by burning it in diesel engines or in relatively small gas turbines or microturbines, which in turn drive generators, with electrical power then being applied directly to power-using equipment or returned to the grid. With the use of either diesel engines or microturbines, it is necessary to first clean the methane gas by filtering or the like, and with diesel engines, there is necessarily significant maintenance involved. Further, with either of these approaches there is still a great deal of energy that is passed to the atmosphere by way of the exhaust gases.

Other possible sources of waste heat that are presently being discharged to the environment are geothermal sources and heat from other types of engines such as gas turbine engines that give off significant heat in their exhaust gases and reciprocating engines that give off heat both in their exhaust gases and to cooling liquids such as water and lubricants.

It is therefore an object of the present invention to provide a new and improved closed rankine cycle power plant that can more effectively use waste heat.

Another object of the present invention is the provision for a rankine cycle turbine that is economical and effective in manufacture and use.

Yet another object of the present invention is the provision for more effectively using the secondary sources of waste heat.

Yet another object of the present invention is the provision for a rankine cycle system which can operate at relatively low temperatures and pressures.

Still another object of the present invention is the provision for a rankine cycle system which is economical and practical in use.

These objects and other features and advantages become more readily apparent upon reference to the following descriptions when taken in conjunction with the appended drawings.

SUMMARY OF THE INVENTION

Briefly, in accordance with one aspect of the invention, a centrifugal compressor which is designed for compression of refrigerant for purposes of air conditioning, is used in a reverse flow relationship so as to thereby operate as a turbine in a closed organic rankine cycle system. In this way, an existing hardware system which is relatively inexpensive, is used to effectively meet the requirements of an organic rankine cycle turbine for the effective use of waste heat.

By another aspect of the invention, a centrifugal compressor having a vaned diffuser is effectively used as a power generating turbine with flow directing nozzles when used in a reverse flow arrangement.

By yet another aspect of the invention, a centrifugal compressor with a pipe diffuser is used as a turbine when operated in a reverse flow relationship, with the individual pipe openings being used as nozzles.

In accordance with another aspect of the invention, a compressor/turbine uses an organic refrigerant as a motive fluid with the refrigerant being chosen such that its operating pressure is within the operating range of the compressor/turbine when operating as a compressor.

In the drawings as hereinafter described, a preferred embodiment is depicted; however various other modifications and alternate constructions can be made thereto without departing from the true spirt and scope of the invention.

DESCRIPTION OF THE PREFERRED EMBODIMENT

Figure 1:
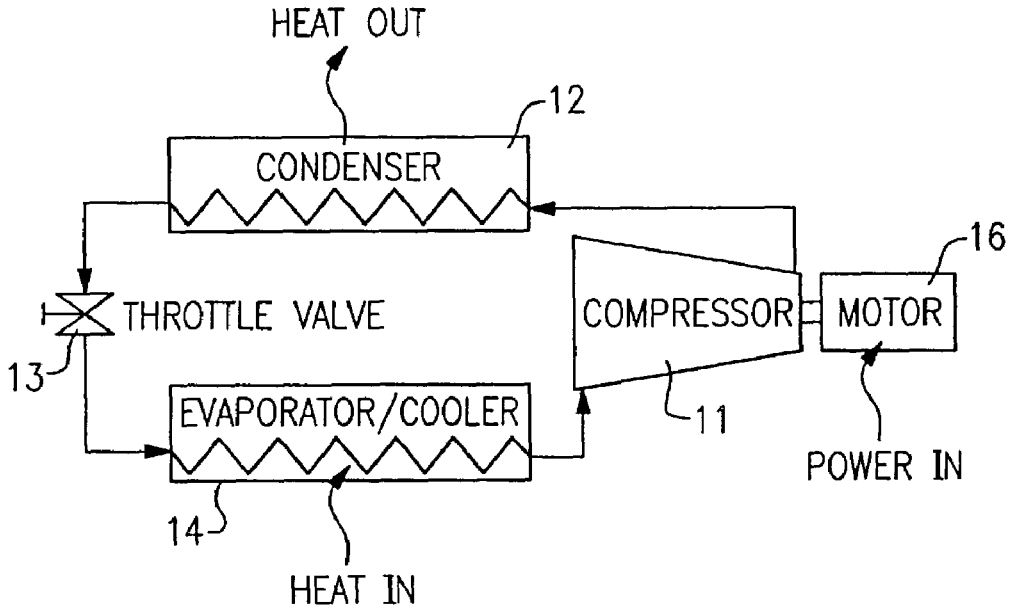
FIG.1 Prior Art
FIG. 1 is a schematic illustration of a vapor compression cycle in accordance with the prior art.

Referring now to FIG. 1, a typical vapor compression cycle is shown as comprising, in serial flow relationship, a compressor 11, a condenser 12, a throttle valve 13, and an evaporator/cooler 14. Within this cycle a refrigerant, such as R-11, R-22, or R-134a is caused to flow through the system in a counterclockwise direction as indicated by the arrows.

The compressor 11 which is driven by a motor 16 receives refrigerant vapor from the evaporator/cooler 14 and compresses it to a higher temperature and pressure, with the relatively hot vapor then passing to the condenser 12 where it is cooled and condensed to a liquid state by a heat exchange relationship with a cooling medium such as air or water. The liquid refrigerant then passes from the condenser to a throttle valve wherein the refrigerant is expanded to a low temperature two-phase liquid/vapor state as it passes to the evaporator/cooler 14. The evaporator liquid provides a cooling effect to air or water passing through the evaporator/cooler. The low pressure vapor then passes to the compressor 11 where the cycle is again commenced.

Depending on the size of the air conditioning system, the compressor may be a rotary, screw or reciprocating compressor for small systems, or a screw compressor or centrifugal compressor for larger systems. A typical centrifugal compressor includes an impeller for accelerating refrigerant vapor to a high velocity, a diffuser for decelerating the refrigerant to a low velocity while converting kinetic energy to pressure energy, and a discharge plenum in the form of a volute or collector to collect the discharge vapor for subsequent flow to a condenser. The drive motor 16 is typically an electric motor which is hermetically sealed in the other end of the compressor 11 and which, through a transmission 26, operates to rotate a high speed shaft.

Figure 2:
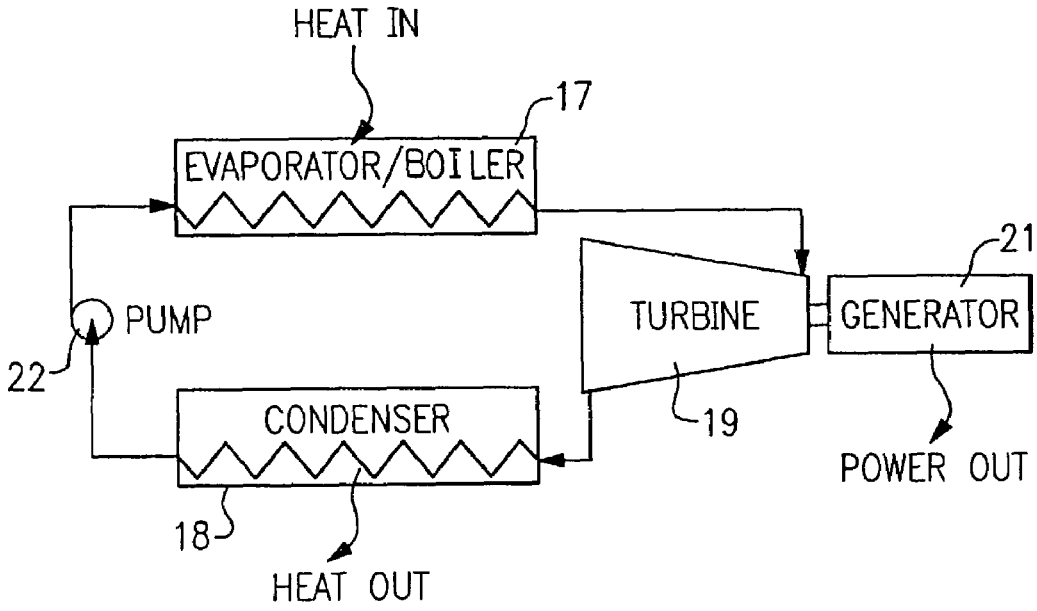
FIG.2 Prior Art
FIG. 2 is a schematic illustration of a rankine cycle system in accordance with the prior art.

A typical rankine cycle system as shown in FIG. 2 also includes an evaporator/cooler 17 and a condenser 18 which, respectively, receives and dispenses heat in the same manner as in the vapor compression cycle as described hereinabove. However, as will be seen, the direction of fluid flow within the system is reversed from that of the vapor compression cycle, and the compressor 11 is replaced with a turbine 19 which, rather then being driven by a motor 16 is driven by the motive fluid in the system and in turn drives a generator 21 that produces power.

In operation, the evaporator which is commonly a boiler having a significant heat input, vaporizes the motive fluid, which is commonly water but may also be a refrigerant, with the vapor then passing to the turbine for providing motive power thereto. Upon leaving the turbine, the low pressure vapor passes to the condenser 18 where it is condensed by way of heat exchange relationship with a cooling medium. The condensed liquid is then circulated to the evaporator/boiler by a pump 22 as shown to complete the cycle.

Figure 3:
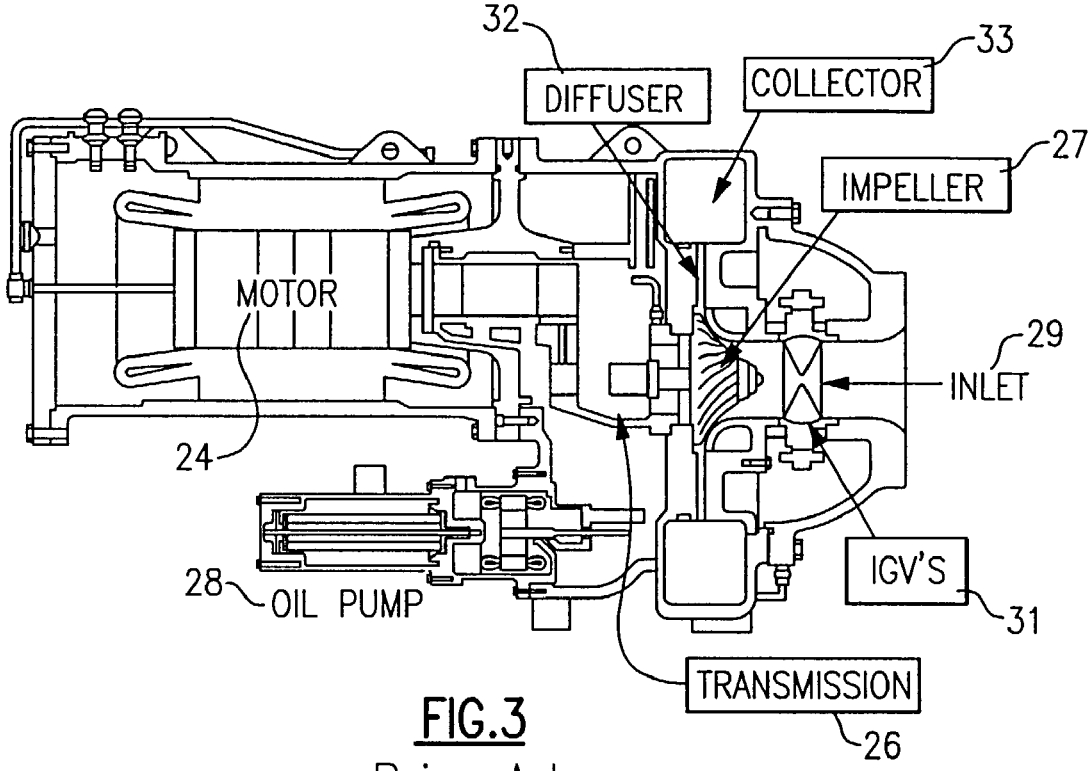
FIG.3 Prior Art
FIG. 3 is a sectional view of a centrifugal compressor in accordance with the prior art.

Referring now to FIG. 3, a typical centrifugal compressor is shown to include an electric drive motor 24 operatively connected to a transmission 26 for driving an impeller 27. An oil pump 28 provides for circulation of oil through the transmission 26. With the high speed rotation of the impeller 27, refrigerant is caused to flow into the inlet 29 through the inlet guide vanes 31, through the impeller 27, through the diffuser 32 and to the collector 33 where the discharge vapor is collected to flow to the condenser as described hereinabove.

Figure 4:
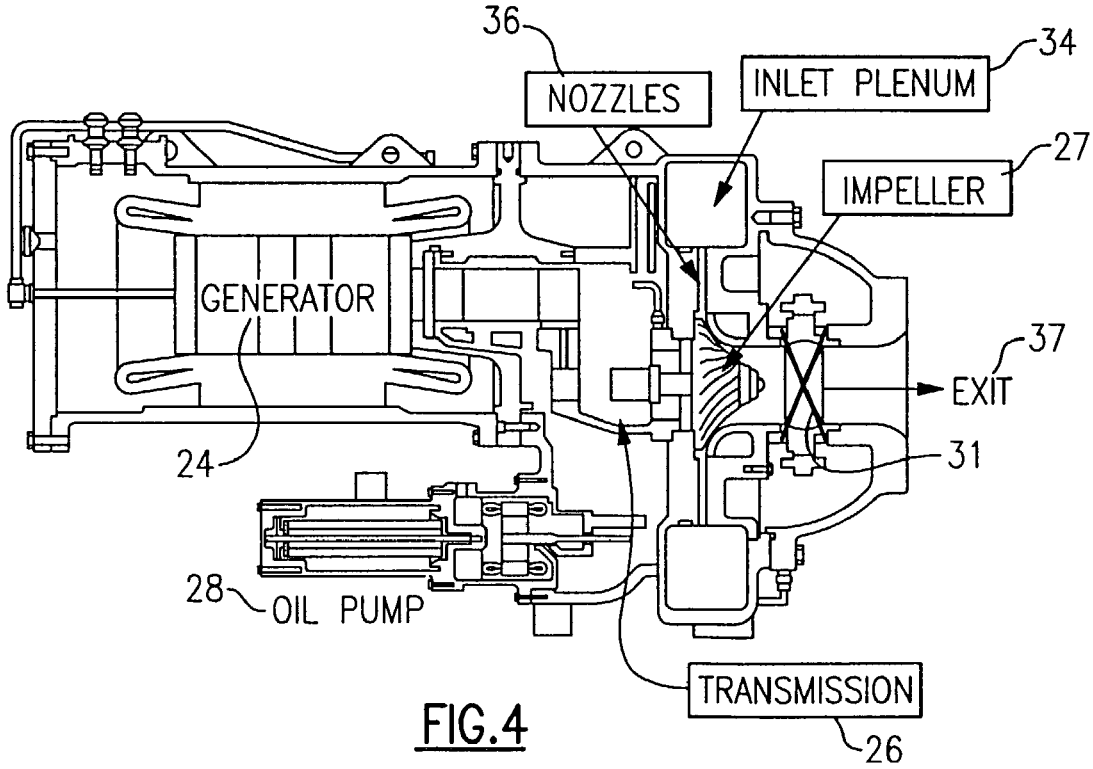
FIG. 4 is a sectional view of a compressor/turbine in accordance with a preferred embodiment of the invention.

In FIG. 4, the same apparatus shown in FIG. 3 is applied to operate as a radial inflow turbine rather then a centrifugal compressor. As such, the motive fluid is introduced into an inlet plenum 34 which had been designed as a collector 33. It then passes radially inwardly through the nozzles 36, which is the same structure which functions as a diffuser in the centrifugal compressor. The motive fluid then strikes the impeller 27 to thereby impart rotational movement thereof. The impeller then acts through the transmission 26 to drive a generator 24, which is the same structure which functioned as a motor in the case of the centrifugal compressor. After passing through the impeller 27 the low pressure gas passes through the inlet guide vanes 31 to an exit opening 37. In this mode of operation, the inlet guide vanes 31 are preferably moved to the fully opened positioned or alternatively, entirely removed from the apparatus.

Figure 5:
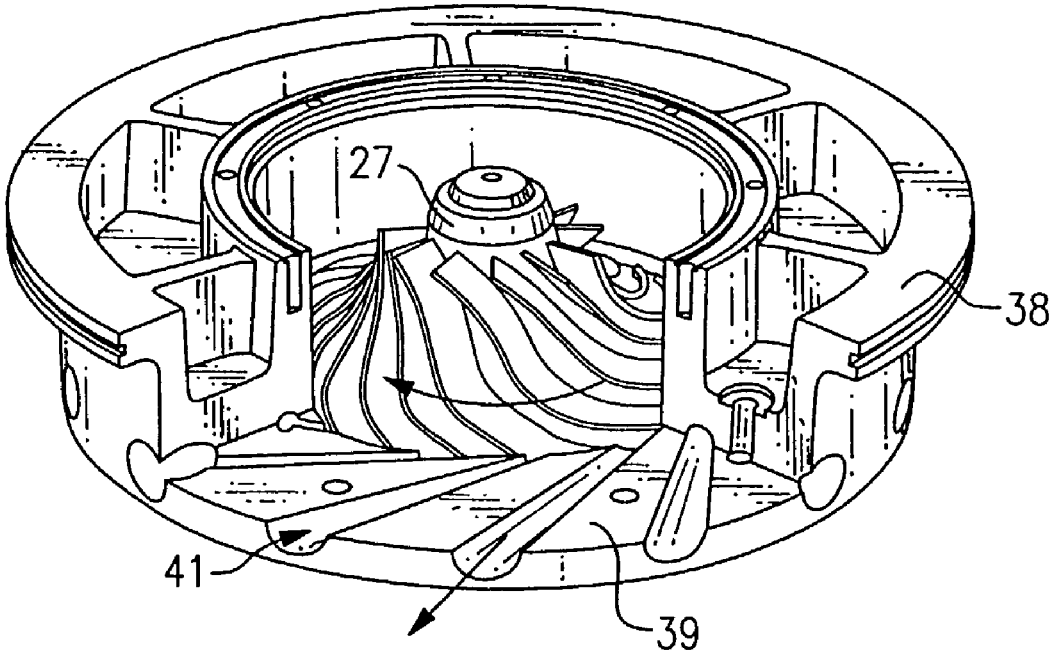
FIG.5 Prior Art
FIG. 5 is a perceptive view of a diffuser structure in accordance with the prior art.

In the centrifugal compressor application as discussed hereinabove the diffuser 32 can be any of the various types, including vaned or vaneless diffusers. One known type of vaned diffuser is known as a pipe diffuser as shown and described in U.S. Pat. No. 5,145,317, assigned to the assignee of the present invention. Such a diffuser is shown at 38 in FIG. 5 as circumferentially surrounding an impeller 27. Here, a backswept impeller 27 rotates in the clockwise direction as shown with the high pressure refrigerant flowing radially outwardly through the diffuser 38 as shown by the arrow. The diffuser 38 has a plurality of circumferentially spaced tapered sections or wedges 39 with tapered channels 41 therebetween. The compressed refrigerant then passes radially outwardly through the tapered channels 41 as shown.

Figure 6:
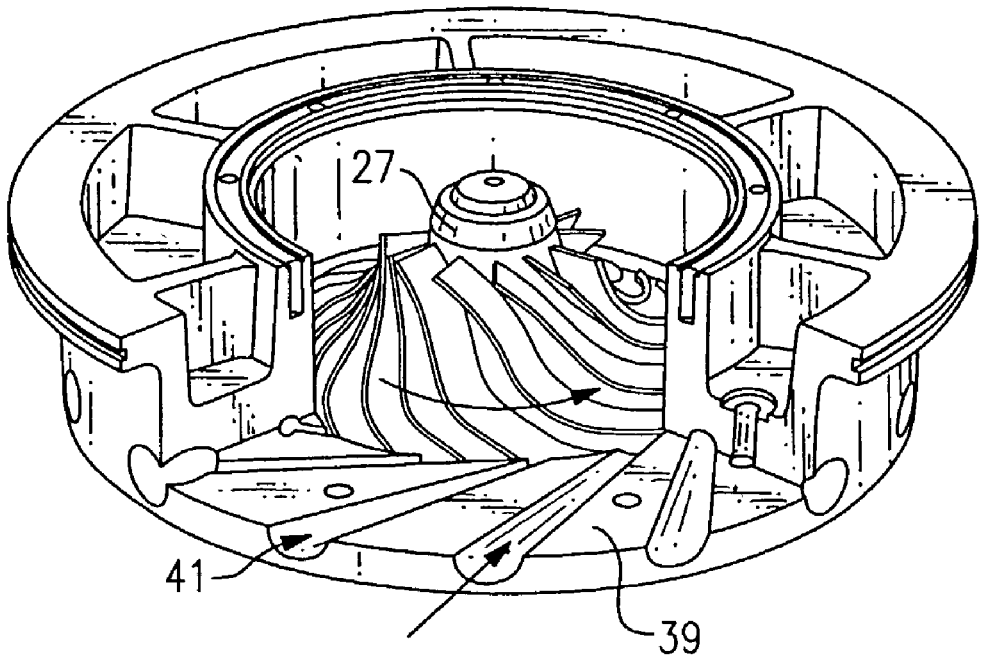
FIG. 6 is a schematic illustration of the nozzle structure in accordance with a preferred embodiment of the invention.

In the application wherein the centrifugal compressor is operated as a turbine as shown in FIG. 6, the impeller 27 rotates in a counterclockwise direction as shown, with the impeller 27 being driven by the motive fluid which flows radially inwardly through the tapered channels 41 as shown by the arrow.

Thus, the same structure which serves as a diffuser 38 in a centrifugal compressor is used as a nozzle, or collection of nozzles, in a turbine application. Further such a nozzle arrangement offers advantages over prior art nozzle arrangements. To consider the differences and advantages over the prior art nozzle arrangements, reference is made to FIGS. 7A and 7B hereof.

Figure 7A:
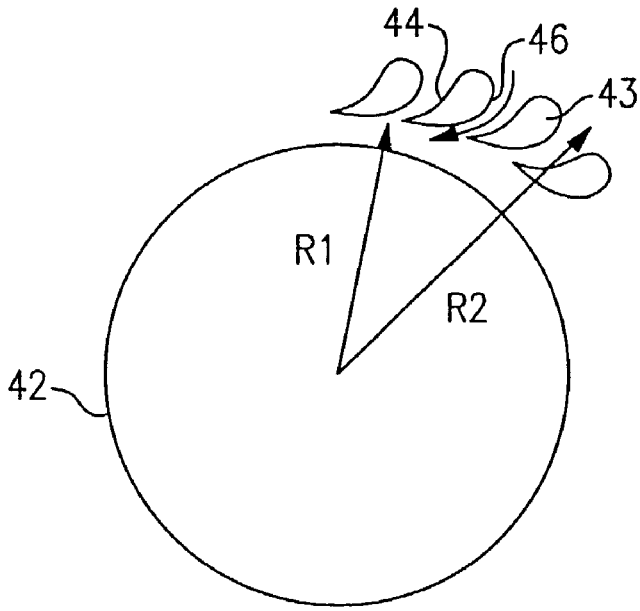
FIG.7A Prior Art
FIGS. 7A and 7B are schematic illustrations of $R_2/R_1$ (outside/inside) radius ratios for turbine nozzle arrangements for the prior art and for the present invention, respectively.

Referring now to FIG. 7A, a prior art nozzle arrangement is shown with respect to a centrally disposed impeller 42 which receives motive fluid from a plurality of circumferentially disposed nozzle elements 43. The radial extent of the nozzles 43 are defined by an inner radius $R_1$ and an outer radius $R_2$ as shown. It will be seen that the individual nozzle elements 43 are relatively short with quickly narrowing cross sectional areas from the outer radius $R_2$ to the inner radius $R_1$. Further, the nozzle elements are substantially curved both on their pressure surface 44 and their suction surface 46, thus causing a substantial turning of the gases flowing therethrough as shown by the arrow.

The advantage of the above described nozzle design is that the overall machine size is relatively small. Primarily for this reason, most, if not all, nozzle designs for turbine application are of this design. With this design, however, there are some disadvantages. For example, nozzle efficiency suffers from the nozzle turning losses and from exit flow non uniformities. These losses are recognized as being relatively small and generally well worth the gain that is obtained from the smaller size machine. Of course it will be recognized that this type of nozzle cannot be reversed so as to function as a diffuser with the reversal of the flow direction since the flow will separate as a result of the high turning rate and quick deceleration.

Figure 7B:
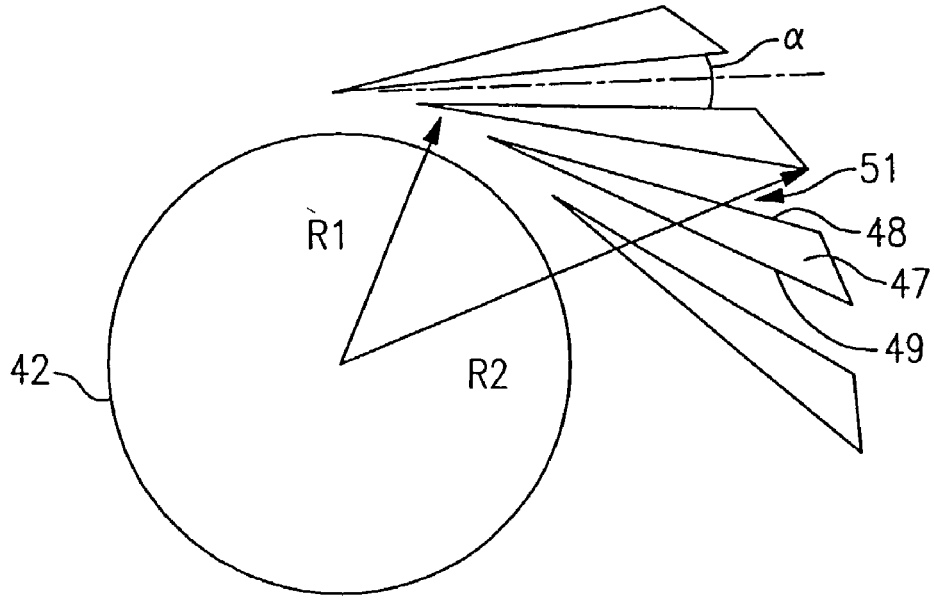

Referring now to FIG. 7B, the nozzle arrangement of the present invention is shown wherein the impeller 42 is circumferentially surrounded by a plurality of nozzle elements 47. It will be seen that the nozzle elements are generally long, narrow and straight. Both the pressure surface 48 and the suction surface 49 are linear to thereby provide relatively long and relatively slowly converging flow passage 51. They include a cone-angle $\propto$ within the boundaries of the passage 51 at preferably less then 9 degrees, and, as will been seen, the center line of these cones as shown by the dashed line, is straight. Because of the relatively long nozzle elements 47, the $R_2/R_1$ ratio is greater then 1.25 and preferably in the range of 1.4.

Because of the greater $R_2/R_1$ ratio, there is a modest increase in the overall machine size (i.e. in the range of 15%) over the conventional nozzle arrangement of FIG. 7A. Further, since the passages 51 are relatively long the friction losses are greater than those of the conventional nozzles of FIG. 7A. However there are also some performance advantages with this design. For example, since there are no turning losses or exit flow non-uniformities, the nozzle efficiency is substantially increased over the conventional nozzle arrangement even when considering the above mentioned friction losses. This efficiency improvement is in the range of 2%. Further, since this design is based on a diffuser design, it can be used in a reversed flow direction for applications as a diffuser such that the same hardware can be used for the dual purpose of both turbine and compressor as described above and as will be more fully described hereinafter.

Figure 8:
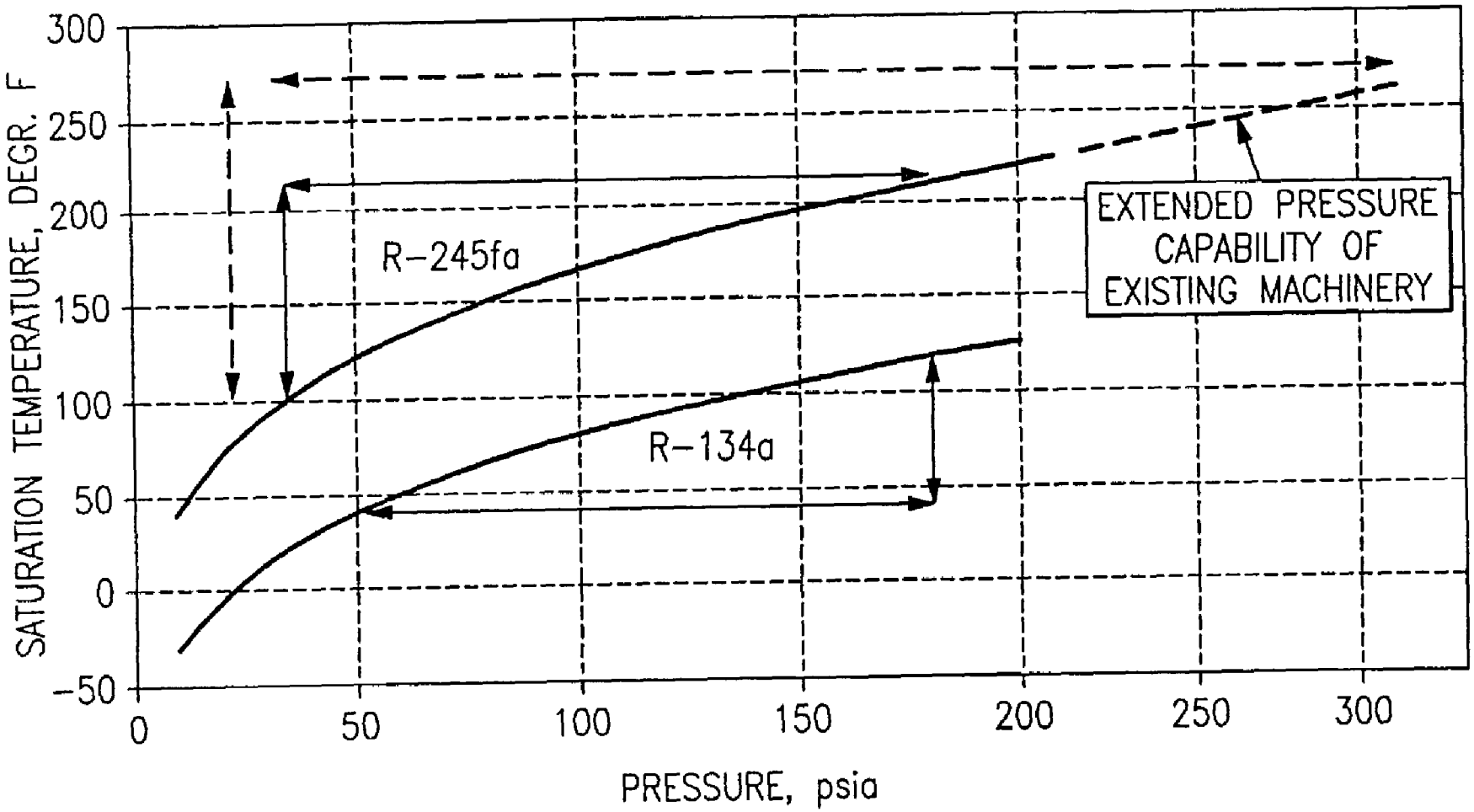
FIG. 8 is a graphical illustration of the temperature and pressure relationships of two motive fluids as used in the compressor/turbine in accordance with a preferred embodiment of the invention.

If the same apparatus is used for an organic rankine cycle turbine application as for a centrifugal compressor application, the applicants have recognized that a different refrigerant must be used. That is, if the known centrifugal compressor refrigerant R-134a is used in an organic rankine cycle turbine application, the pressure would become excessive. That is, in a centrifugal compressor using R-134a as a refrigerant, the pressure range will be between 50 and 180 psi, and if the same refrigerant is used in a turbine application as proposed in this invention, the pressure would rise to around 500 psi, which is above the maximum design pressure of the compressor. For this reason, it has been necessary for the applicants to find another refrigerant that can be used for purposes of turbine application. Applicants have therefore found that a refrigerant R-245fa, when applied to a turbine application, will operate in pressure ranges between 40-180 psi as shown in the graph of FIG. 8. This range is acceptable for use in hardware designed for centrifugal compressor applications. Further, the temperature range for such a turbine system using R-245fa is in the range of 100-200° F., which is acceptable for a hardware system designed for centrifugal compressor operation with temperatures in the range of 40-110° F. It will thus be seen in FIG. 8 that air conditioning equipment designed for R-134a can be used in organic rankine cycle power generation applications when using R-245fa. Further, it has been found that the same equipment can be safely and effectively used in higher temperatures and pressure ranges (e.g. 270° and 300 psia are shown by the dashed lines in FIG. 8), thanks to the extra safety margin of the existing compressor.

Figure 9:
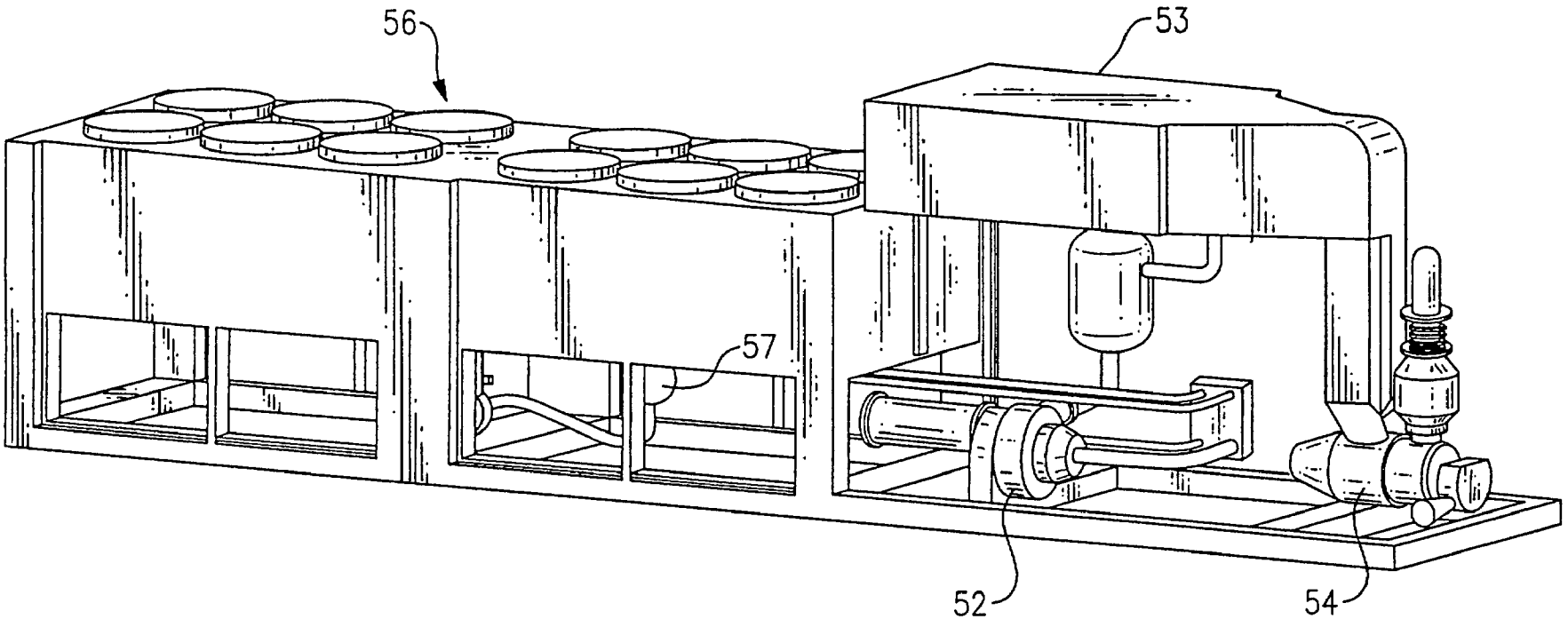
FIG. 9 is a perceptive view of a rankine cycle system with its various components in accordance-with a preferred embodiment of the invention.

Having discussed the turbine portion of the present invention, we will now consider the related system components that would be used with the turbine. Referring to FIG. 9, the turbine which has been discussed hereinabove is shown at 52 as an ORC turbine/generator, which is commercially available as a Carrier 19XR2 centrifugal compressor which is operated in reverse as discussed hereinabove. The boiler or evaporator portion of the system is shown at 53 for providing relatively high pressure high temperature R-245fa refrigerant vapor to a turbine/generator 52. In accordance with one embodiment of the invention, the needs of such a boiler/evaporator may be provided by a commercially available vapor generator available from Carrier Limited Korea with the commercial name of 16JB.

The energy source for the boiler/evaporator 53 is shown at 54 and can be of any form of waste heat that may normally be lost to the atmosphere. For example, it may be a small gas turbine engine such as a Capstone C60, commonly known as a microturbine, with the heat being derived from the exhaust gases of the microturbine. It may also be a larger gas turbine engine such as a Pratt & Whitney FT8 stationary gas turbine. Another practical source of waste heat is from internal combustion engines such as large reciprocating diesel engines that are used to drive large generators and in the process develop a great deal of heat that is given off by way of exhaust gases and coolant liquids that are circulated within a radiator and/or a lubrication system. Further, energy may be derived from the heat exchanger used in the turbocharger intercooler wherein the incoming compressed combustion air is cooled to obtain better efficiency and larger capacity.

Finally, heat energy for the boiler may be derived from geothermal sources or from landfill flare exhausts. In these cases, the burning gases are applied directly to the boiler to produce refrigerant vapor or applied indirectly by first using those resource gases to drive an engine which, in turn, gives off heat which can be used as described hereinabove.

After the refrigerant vapor is passed through the turbine 52, it passes to the condenser 56 for purposes of condensing the vapor back to a liquid which is then pumped by way of a pump 57 to the boiler/evaporator 53. Condenser 56 may be of any of the well known types. One type that is found to be suitable for this application is the commercially available air cooled condenser available from Carrier Corporation as model number 09DK094. A suitable pump 57 has been found to be the commercially available as the Sundyne P2CZS.

While the present invention has been particularly shown and described with reference to preferred and alternate embodiments as illustrated in the drawings, it will be understood by one skilled in the art that various changes in detail may be effected therein without departing from the spirit and scope of the invention as defined by the claims.

We claim:

1. A method of operating an organic rankine cycle system having in serial flow relationship, a pump, an evaporator, a turbine and a condenser comprising the steps of:

introducing to a plurality of nozzles in said turbine, a relatively high pressure, high temperature organic refrigerant vapor to flow therethrough and engage an impeller for imparting a driving force thereto;

wherein said refrigerant is R-245fa and further;

wherein said nozzles are of the vaned type.

2. A method as set forth in claim 1 wherein said nozzles are frustro-conical in cross sectional shape.

3. A method of operating an organic rankine cycle system having in serial flow relationship, a pump, an evaporator, a turbine and a condenser comprising the steps of:

introducing to a plurality of nozzles in said turbine, a relatively high pressure, high temperature organic refrigerant vapor to flow therethrough and engage an impeller for imparting a driving force thereto;

wherein said refrigerant is R-245fa and further;

wherein said refrigerant is introduced at temperatures in the range of 210-270° F.

4. A method of operating an organic rankine cycle system having in serial flow relationship, a pump, an evaporator, a turbine and a condenser comprising the steps of:

introducing to a plurality of nozzles in said turbine, a relatively high pressure, high temperature organic refrigerant vapor to flow therethrough and engage an impeller for imparting a driving force thereto;

wherein said refrigerant is R-245fa and further;

wherein said refrigerant is introduced at temperatures in the range of 180-330 psia.

5. A method of operating an organic rankine cycle system having in serial flow relationship, a pump, an evaporator, a turbine and a condenser comprising the steps of:

introducing to a plurality of nozzles in said turbine, a relatively high pressure, high temperature organic refrigerant vapor to flow therethrough and engage an impeller for imparting a driving force thereto;

wherein said refrigerant is R-245fa and further;

wherein said condenser is water cooled.

6. A method of operating an organic rankine cycle system having in serial flow relationship, a pump, an evaporator, a turbine and a condenser comprising the steps of:

introducing to a plurality of nozzles in said turbine, a relatively high pressure, high temperature organic refrigerant vapor to flow therethrough and engage an impeller for imparting a driving force thereto;

wherein said refrigerant is R-245fa and further;

wherein said nozzles are defined by radially inner and outer radii $R_1$ and $R_2$ respectively, and further wherein $R_2/R_1>1.25$.

7. An organic rankine cycle system of the type having in serial flow relationship, a pump, an evaporator, a turbine and a condenser, wherein said turbine comprises:

an arcuately disposed volute for receiving an organic refrigerant vapor medium from the evaporator and for conducting th flow of said vapor radially inwardly;

a plurality of nozzles circumferentially spaced and disposed around the inner periphery of said volute for receiving a flow of vapor therefrom and conducting it radially inwardly; and an impeller disposed radially within said nozzles such that the radial inflow of vapor from said nozzles impinges on the plurality of circumferentially spaced blades on said impeller to cause rotation of said impeller; and discharge flow means for conducting the flow of vapor from said turbine to the condenser;

wherein said organic refrigerant vapor medium is R-245fa and further;

wherein said plurality of nozzles are of the vaned type.

8. A rankine cycle system as set forth in claim 7 wherein said nozzles are each comprised of a frustro conical passageway.

9. An organic rankine cycle system of the type having in serial flow relationship, a pump, an evaporator, a turbine and a condenser, wherein said turbine comprises:

an arcuately disposed volute for receiving an organic refrigerant vapor medium from the evaporator and for conducting th flow of said vapor radially inwardly;

a plurality of nozzles circumferentially spaced and disposed around the inner periphery of said volute for receiving a flow of vapor therefrom and conducting it radially inwardly; and an impeller disposed radially within said nozzles such that the radial inflow of vapor from said nozzles impinges on the plurality of circumferentially spaced blades on said impeller to cause rotation of said impeller; and discharge flow means for conducting the flow of vapor from said turbine to the condenser;

wherein said organic refrigerant vapor medium is R-245fa and further;

wherein the pressure of a vapor entering said volute is in the range of 180-330 psia.

10. An organic rankine cycle system of the type haying in serial flow relationship, a pump, an evaporator, a turbine and a condenser, wherein said turbine comprises:

an arcuately disposed volute for receiving an organic refrigerant vapor medium from the evaporator and for conducting th flow of said vapor radially inwardly;

a plurality of nozzles circumferentially spaced and disposed around the inner periphery of said volute for receiving a flow of vapor therefrom and conducting it radially inwardly; and an impeller disposed radially within said nozzles such that the radial inflow of vapor from said nozzles impinges on the plurality of circumferentially spaced blades on said impeller to cause rotation of said impeller; and discharge flow means for conducting the flow of vapor from said turbine to the condenser;

wherein said organic refrigerant vapor medium is R-245fa and further;

wherein the saturation temperature of the vapor entering the volute is in the range of 210-270° F.

11. An organic rankine cycle system of the type having in serial flow relationship, a pump, an evaporator, a turbine and a condenser, wherein said turbine comprises:

an arcuately disposed volute for receiving an organic refrigerant vapor medium from the evaporator and for conducting th flow of said vapor radially inwardly;

a plurality of nozzles circumferentially spaced and disposed around the inner periphery of said volute for receiving a flow of vapor therefrom and conducting it radially inwardly; and an impeller disposed radially within said nozzles such that the radial inflow of vapor from said nozzles impinges on the plurality of circumferentially spaced blades on said impeller to cause rotation of said impeller; and discharge flow means for conducting the flow of vapor from said turbine to the condenser;

wherein said organic refrigerant vapor medium is R-245fa and further;

wherein said muzzles are defined by radially inner and outer radii $R_1$ and $R_2$ respectively, and further wherein $R_2/R_1>1.25$.

* * * * *